US007345243B2

(12) United States Patent
Bolouri-Saransar et al.

(10) Patent No.: US 7,345,243 B2
(45) Date of Patent: Mar. 18, 2008

(54) COMMUNICATION CABLE WITH VARIABLE LAY LENGTH

(75) Inventors: Masud Bolouri-Saransar, Orland Park, IL (US); Michael V. Doorhy, Mokena, IL (US); David R. Hawkins, Sugar Hill, GA (US); Asef Nimer Baddar, Independence, KY (US); Thomas Gerard McLaughlin, Taylor Mill, KY (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 11/304,867

(22) Filed: Dec. 15, 2005

(65) Prior Publication Data

US 2006/0162949 A1 Jul. 27, 2006

Related U.S. Application Data

(60) Provisional application No. 60/637,239, filed on Dec. 17, 2004.

(51) Int. Cl.
*H01B 11/02* (2006.01)

(52) U.S. Cl. ..... 174/113 R

(58) Field of Classification Search ..... 174/113 R, 174/27

See application file for complete search history.

(56) References Cited

U.S. PATENT DOCUMENTS 5,739,473 A * 4/1998 Zerbs ..... 174/121 A
5,814,768 A 9/1998 Wessels et al.
5,952,607 A 9/1999 Friesen et al.
6,211,467 B1 4/2001 Berelsman et al.
6,452,094 B2 9/2002 Donner et al.
6,770,819 B2 8/2004 Patel
6,818,832 B2 11/2004 Hopkinson et al.
6,875,928 B1 4/2005 Hayes et al.
2005/0092514 A1 5/2005 Kenny et al.
2005/0092515 A1 5/2005 Kenny et al.
2005/0279528 A1 12/2005 Kenny et al.

FOREIGN PATENT DOCUMENTS

EP 0 061 246 9/1982
EP 0 061 247 9/1982
EP 1 174 886 A2 1/2002
EP 1 215 688 A1 6/2002
GB 147264 7/1920

(Continued)

*Primary Examiner*—Chau N. Nguyen
(74) *Attorney, Agent, or Firm*—Robert A. McCann; Zachary J. Smolinski

(57) ABSTRACT

Communication cables are provided in which a core lay length of the cable varies along the cable length. The cable may be provided with different segments that have different core lay lengths. It is desirable for neighboring core lay lengths in a cable to differ by a factor of two, to enable a reduction in power-sum alien near-end crosstalk (PSAN-EXT) when two cables are installed alongside one another. Segments of the cable having different core lay lengths may be spaced periodically along the length of the cable, and the periodicity of the spacing may be altered by a jitter distance. The introduction of jitter into the periodicity of the spacing of the segments increases the likelihood that a beneficial placement of core lay lengths will occur when two or more cables are installed alongside one another.

28 Claims, 7 Drawing Sheets

FOREIGN PATENT DOCUMENTS

| | | | |
|---|---|---|---|
| GB | 205018 | | 10/1923 |
| GB | 380969 | | 9/1932 |
| GB | 764056 | | 12/1956 |
| GB | 1 527 552 | | 10/1978 |
| GB | 2 176 926 | A1 | 1/1987 |
| JP | 58-214219 | | 12/1983 |
| JP | 59-189508 | | 10/1984 |
| JP | 62-202417 | | 9/1987 |
| JP | 62-216110 | | 9/1987 |
| JP | 06-349344 | * | 12/1994 |
| JP | 2001-023455 | | 1/2001 |
| JP | 2001-184954 | | 7/2001 |
| JP | 2003-077345 | | 3/2003 |
| WO | WO 83/01706 | | 5/1983 |
| WO | WO 97/25725 | | 7/1997 |
| WO | WO 01/41158 | A1 | 6/2001 |

* cited by examiner

COMMUNICATION CABLE WITH VARIABLE LAY LENGTH

CROSS-REFERENCE TO RELATED APPLICATION

This application claims the benefit of U.S. Provisional Application No. 60/637,239, filed Dec. 17, 2004 and entitled "Communication Cable with Variable Lay Length," which is also incorporated herein by reference in its entirety.

FIELD OF THE INVENTION

The present invention is generally directed to communication cables and more specifically directed to communication cables having variable lay lengths.

BACKGROUND OF THE INVENTION

Communication cables comprised of multiple twisted pairs of conductors are common, with four-pair cables being widely used. In a four-pair cable, the twisted pairs of conductors may in turn be twisted around a central axis of the cable. The length of cable in which one complete twist of the twisted pairs is completed around the cable's central axis is considered the "core lay length" of the cable. For example, if the twisted pairs complete one rotation around the central axis of the cable every six inches, the core lay length of the resulting cable is six inches.

A communication channel may comprise a communication cable with connectors at the ends of the cable. Suppression of crosstalk in and between communication channels is important, because crosstalk can reduce the signal-to-noise ratio in a channel and increase the channel's bit error rate. Power-sum alien near-end crosstalk ("PSANEXT") between channels can be caused by common-mode noise introduced into the channels at connectors. This common mode noise is relative to one conductor pair within a channel, and the common mode noise has its greatest impact when adjacent cables have identical core lay lengths. As communication bandwidth increases, the reduction of crosstalk between channels becomes increasingly important.

SUMMARY OF THE INVENTION

According to one embodiment of the present invention, an improved communication cable has core lay lengths that vary along the length of the cable.

According to some embodiments of the present invention, segments of the cable are provided with approximately uniform core lay lengths along the segment lengths, and core lay lengths of the cable vary by a factor of two among neighboring segments of the cable.

The transition length within the cable from one core lay length to a different neighboring core lay length may be kept short to help reduce PSANEXT between adjacent channels.

Multiple core lay lengths may be used along a length of cable.

The lengths of cable segments with different core lay lengths may be kept approximately periodic. Jitter may be introduced into the periodicity to reduce the likelihood of adjacent lengths of cable having identical core lay lengths when cables are installed alongside one another.

DETAILED DESCRIPTION OF THE ILLUSTRATED EMBODIMENTS

In high-bandwidth communication applications, communication cables are commonly installed alongside one another and PSANEXT can result between adjacent or nearby communication cables. PSANEXT between communication cables is greatest when the adjacent communication cables—or adjacent segments of communication cables—have identical core lay lengths. Thus, to decrease PSANEXT it is desirable to minimize the likelihood of adjacent communication cables—or cable segments—having identical core lay lengths. Further, PSANEXT is effectively canceled out if the core lay lengths of adjacent cables or adjacent cable segments differ by a factor of two. Thus, to further decrease PSANEXT it is desirable to maximize the likelihood of adjacent communication cables—or cable segments—having core lay lengths that differ by a factor of two.

Figure 1:
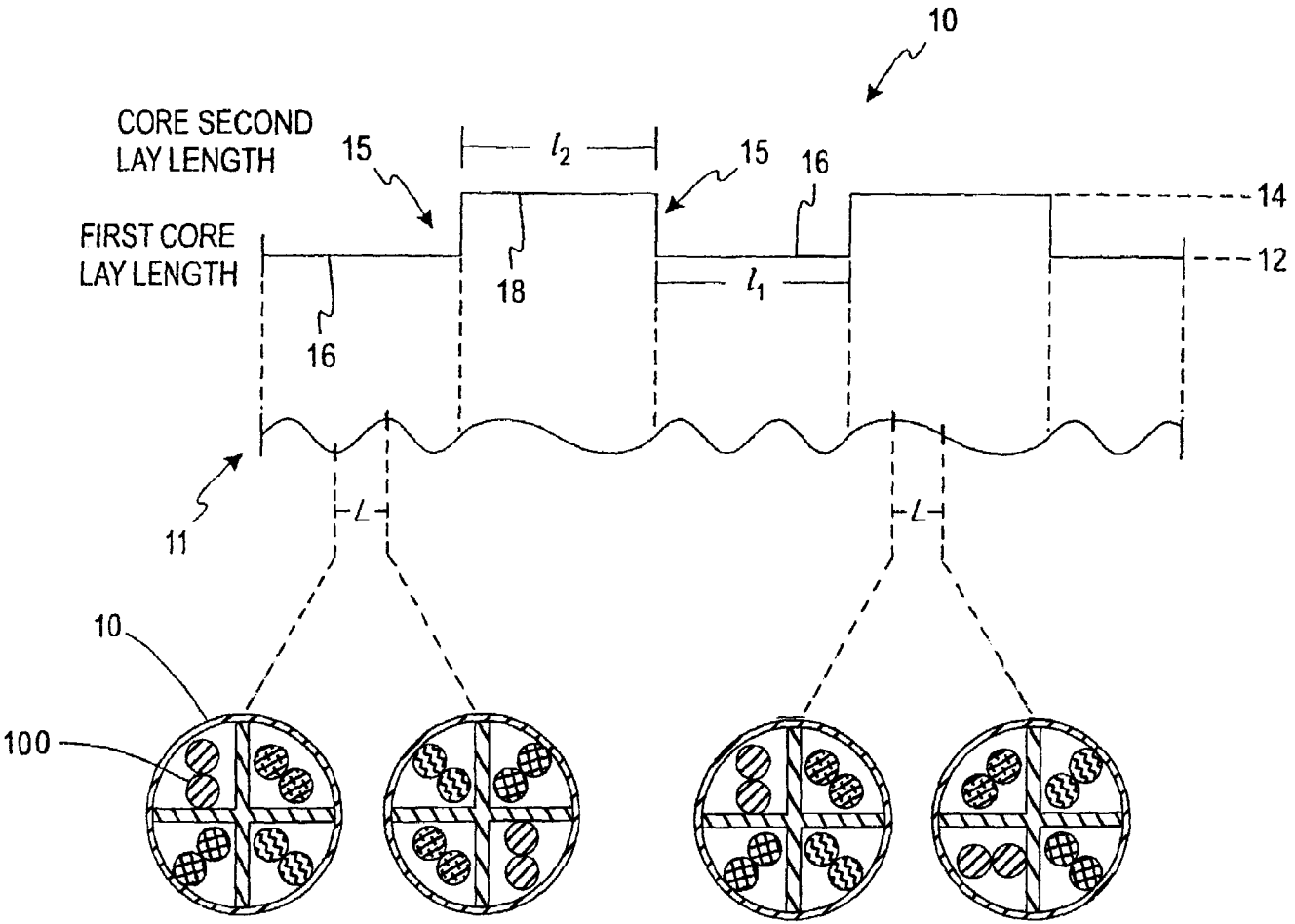
FIG. 1 is a graph view of a communication cable having two alternating core lay lengths.

A cable may be provided with a core lay length that varies along the length of the cable. FIG. 1 is a graph showing a length, L, of cable 10 in which the cable is provided with two different core lay lengths. A first core lay length is graphically represented in a state diagram by a first level 12, and a second core lay length is graphically represented by a second level 14. According to one embodiment, the second core lay length differs from the first core lay length by a factor of two. For example, if the first core lay length is 3 inches, the second core lay length may be 6 inches.

The differences in the core lay lengths are illustrated in an exaggerated fashion by the wave illustration 11 of the core lay lengths of FIG. 1. The wave illustration shows the rotational orientation of a single twisted pair of the cable. In segments 16 of the cable 10, the twisted pair of the cable makes two complete rotations around the central axis of the cable. However, in segments 18 of the cable 10, the twisted pair of the cable makes only one complete rotation around the central axis of the cable in the same distance. That is, the core lay length of the cable in the segments 18 is twice as long as the core lay length of the cable in the segments 16. Four cross-sectional views of the cable 10 illustrate this, showing the change in orientation of the twisted pairs 100 for the same length L in the different segments 16, 18. Cables according to the present invention will be illustrated using state diagrams as shown in FIG. 1. Different states of the state diagrams correspond to different core lay lengths of the cable and not necessarily to other properties of the cable.

Transition regions 15 are provided between segments 16 of the cable 10 having the first core lay length and segments 18 of the cable 10 having the second core lay length. The benefits of aligning segments having the first and second core lay lengths are not present along the transition regions 15, and thus it is desirable for the lengths of the transition regions 15 to be small in relation to the length of the cable. According to one embodiment, the transition regions 15 have lengths of from about 5 to about 15 feet. According to another embodiment, the transition regions 15 have lengths equal to or less than approximately ten feet, or equal to or less than approximately 18% of a length of cable. Other transition lengths may be available, depending on the capabilities of the cable manufacturing process.

As shown in FIG. 1, segments 16 of the cable 10 in which the cable has the first core lay length have a length $l_1$, and segments 18 of the cable 10 in which the cable has the second core lay length have a length $l_2$. In the embodiment shown in FIG. 1, $l_1$, is equal to $l_2$, and thus the variation in core lay length along the length L of the cable is periodic, with a duty cycle of 50%. When $l_1$ is equal to $l_2$, it is possible to align the cable 10 with a second cable 20 having the same alternating core lay length segments as shown in FIG. 2.

Figure 2:
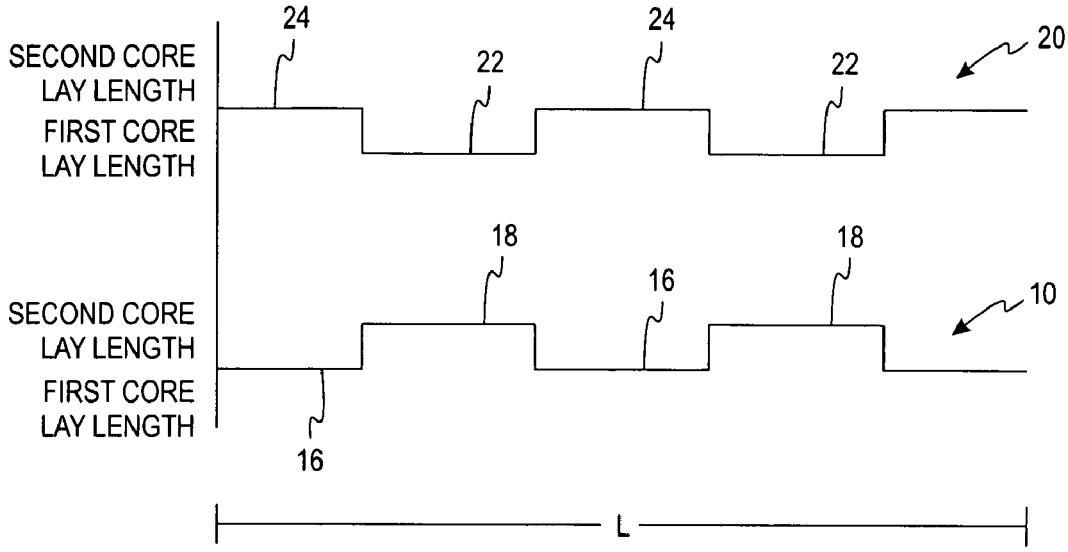
FIG. 2 is a graph view of an example of an ideal alignment for two communication cables having alternating core lay lengths.

In the alignment shown in FIG. 2, segments 16 of the first cable 10 having the first core lay length are aligned with segments 24 of the second cable 20 having the second core lay length. Further, segments 18 of the first cable 10 having the second core lay length are aligned with segments 22 of the second cable 20 having the first core lay length. Because adjacent segments of the first and second cables almost always have core lay lengths differing by a factor of two, this alignment results in decreased ANEXT between the first cable 10 and the second cable 20. Note that transition regions between the two different lay lengths will result in some portions of the adjacent cables that do not have perfectly differing core lay lengths.

Figure 3:
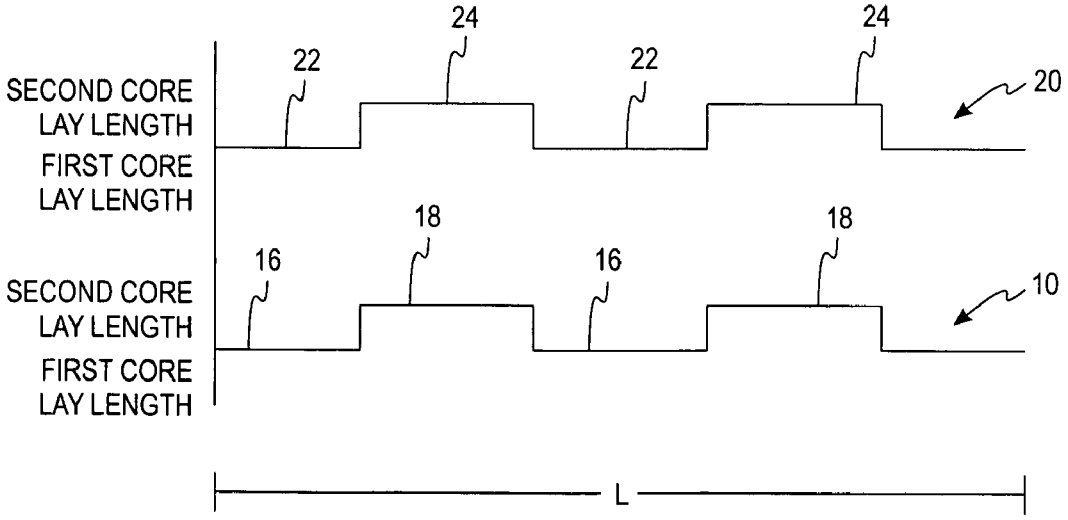
FIG. 3 is a graph view of poor alignment for two communication cables having alternating core lay lengths.

Returning to FIG. 1, when two cables in which $l_1$ is equal to $l_2$ are placed adjacent each other, it is also possible for the alignment in FIG. 3 to result. In this alignment, segments 16 of the first cable 10 having the first core lay length are aligned with segments 22 of the second cable 20 having the first core lay length. Further, segments 18 of the first cable 10 having the second core lay length are aligned with segments 24 of the second cable 20 having the second core lay length. This undesirable alignment results in increased ANEXT between the first cable 10 and the second cable 20.

Figure 4:
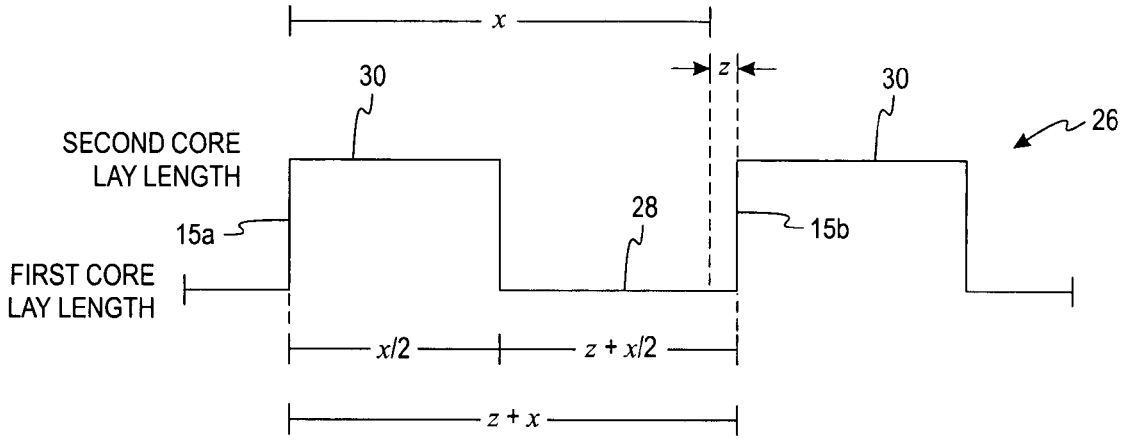
FIG. 4 is a graph view of a communication cable having alternating segments with two different core lay lengths, with a jitter distance introduced into the lengths of the alternating segments.

Turning now to FIG. 4, a cable 26 is shown in which segments 28 of the cable having a first core lay length alternate with segments 30 having a second core lay length. In contrast to the strictly periodic core lay lengths shown in FIG. 1, the periodicity of the core lay length in the cable 26 of FIG. 4 is altered by a "jitter" distance, shown as "z" in FIG. 4. The jitter distance z may result in either a lengthening or a shortening of individual segments 28 and 30, and the jitter distance z is small in relation to the lengths of the segments 28 and 30. An average cycle length between transition regions 15*a* and 15*b* is shown as x in FIG. 4, and the jitter distance z results in variations of the cycle length about the average cycle length x. In the embodiment of FIG. 4, the nominal length of the segment 30 is given as "x/2" and the length of the segment 28 is given as "z+x/2." During the manufacturing process, the jitter distance z is added to or subtracted from the nominal lengths of segments. That is, the magnitude and sign of the jitter distance z may change substantially randomly along the length of the cable 26. According to some embodiments, it is desirable to keep the jitter distance z small in relation to the average cycle length x. According to one embodiment of the present invention, the maximum magnitude of the jitter distance z is kept at less than approximately 50% of the nominal segment length, "x/2", along a length of cable. According to some embodiments of the invention, a jitter distance may be added to or subtracted from lengths of segments of the cable having a first core lay length, segments of the cable having a second core lay length, or both types of cable segments. As discussed below, jitter distances may be incorporated into cables having more than two alternating core lay lengths.

Cables according to the present invention may be manufactured with a variety of values for the nominal segment lengths, "x/2", as shown in FIG. 4. According to one embodiment, the nominal segment length is approximately 50 feet. It has further been found that nominal segment lengths of between approximately 100 feet and 200 feet are beneficial to reduce PSANEXT when cables are installed alongside one another.

Figure 5:
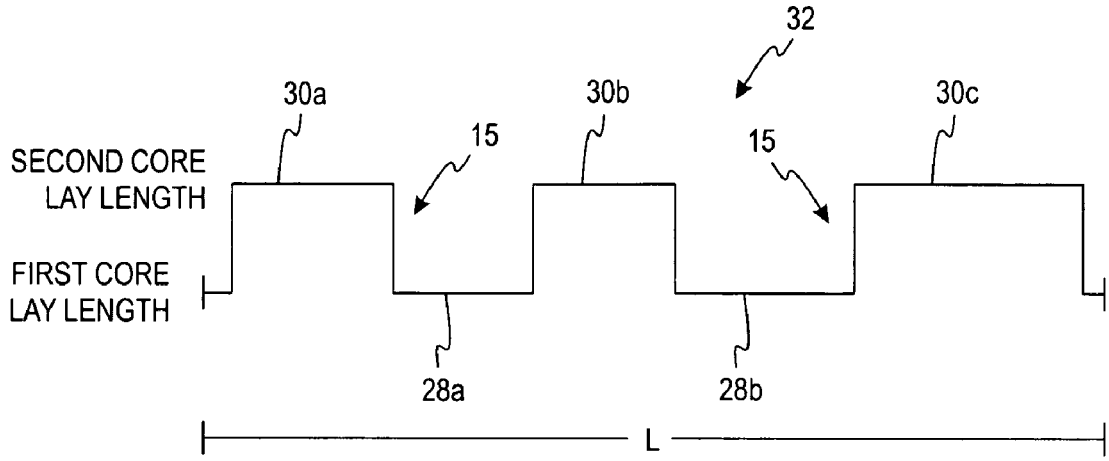
FIG. 5 is a graph view of a communication cable having segments with alternating core lay lengths, with the lengths of the segments being altered by a jitter distance.

Because the magnitude and sign of the jitter distance z may change along the length of the cable, segments 28 having the first core lay length may vary in length from one to the next, as may segments 30 having the second core lay length in some embodiments. A graphical diagram of a portion of a resulting cable is shown in FIG. 5. In the length L of the cable 32 shown in FIG. 5, two segments 28*a* and 28*b* have the first core lay length and three segments 30*a*, 30*b*, and 30*c* have the second core lay length, which is a factor of two greater than or less than the first core lay length. Transition regions 15 are portions of the cable 32 in which the core lay length is changing between the first and the second core lay lengths.

In the cable 32 shown in FIG. 5, the first segment 28*a* having the first core lay length is somewhat shorter than the second segment 28*b* having the first core lay length, reflecting that a jitter distance was added during the formation of the cable 32 between these two segments. In the segments of the cable 32 having the second core lay length, the second segment 30*b* is shorter than the first segment 30*a*, and the third segment 30*c* is longer than each of the first segment 30*a* and the second segment 30*b*. Again, the differences in the lengths of the segments is due to jitter distances being added to or subtracted from the segment lengths during production of the cable 32.

Figure 6:
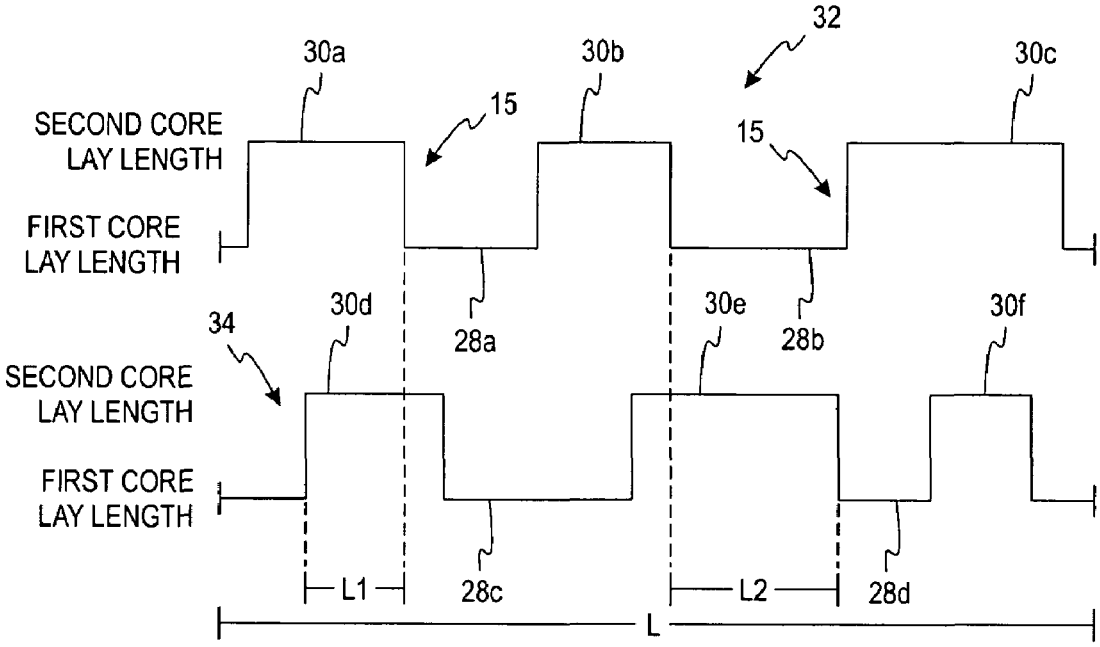
FIG. 6 is a graph view showing an alignment of two communication cables having segments with alternating core lay lengths, with the lengths of the segments being altered by a jitter distance.

Turning now to FIG. 6, the length L of the cable 32 of FIG. 5 is shown adjacent a second cable 34 that is also produced by incorporating jitter lengths into the cable segments. As illustrated, the resulting alignment is unlike the alignments of FIGS. 2 and 3, which illustrate good and poor alignments of perfectly periodic cables. Rather, the alignment of FIG. 6 has some regions, such as region $L_1$, in which a portion of the first cable 32 having the second core lay length aligns with a portion of the second cable 34 having the second core lay length. The alignment of FIG. 6 has other regions, such as region $L_2$, in which two segments of differing core lay lengths align with each other. Cables incorporating jitter into their core lay lengths will show a decreased amount of PSANEXT when multiple cables are installed alongside one another, but will not exhibit either the perfect alignment of FIG. 2 or the poor alignment of FIG. 3.

Figure 7:
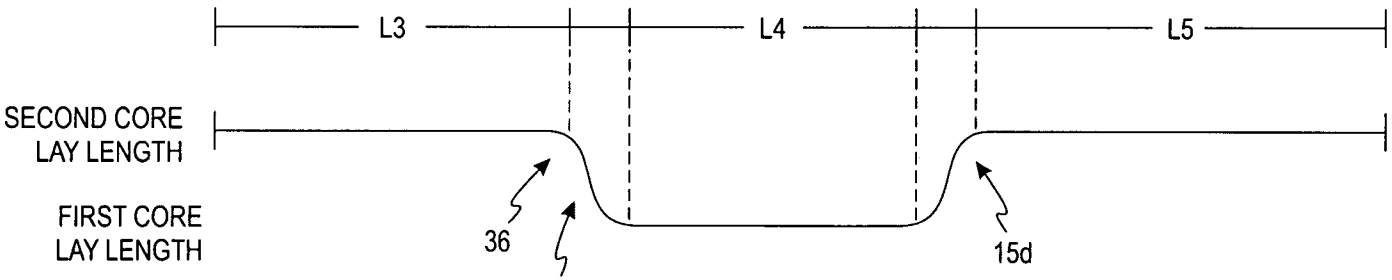
FIG. 7 is a graphical view of a length of cable having alternating core lay lengths more clearly illustrating transition regions between segments of two different core lay lengths.

In FIGS. 1-6, the cable lengths have been drawn for comparison with neighboring cable lengths, and thus the transition regions 15 between core lay lengths have been illustrated simply as vertical state transition lines. In fact, the transition regions 15 may occupy a substantial length of a cable because of the time necessary during cable manufacturing to transition the cabling process from one core lay length to another core lay length. A more realistic depiction of the transition regions 15 is shown in FIG. 7. In FIG. 7, three lengths, $L_3$, $L_4$, and $L_5$ of a cable 36 are shown separated by transition regions 15*c* and 15*d*. In the embodiment shown in FIG. 7, each of the transition regions 15*c* and 15*d* has a length of approximately ten feet. The first length $L_3$ is approximately 50 feet; the second length $L_4$ is approximately 40 feet, and the third length $L_5$ is approximately 60 feet. The length $L_4$ has a first core lay length, and the lengths $L_3$ and $L_5$ have a second core lay length, as represented by the two levels shown in FIG. 7.

Figure 8:
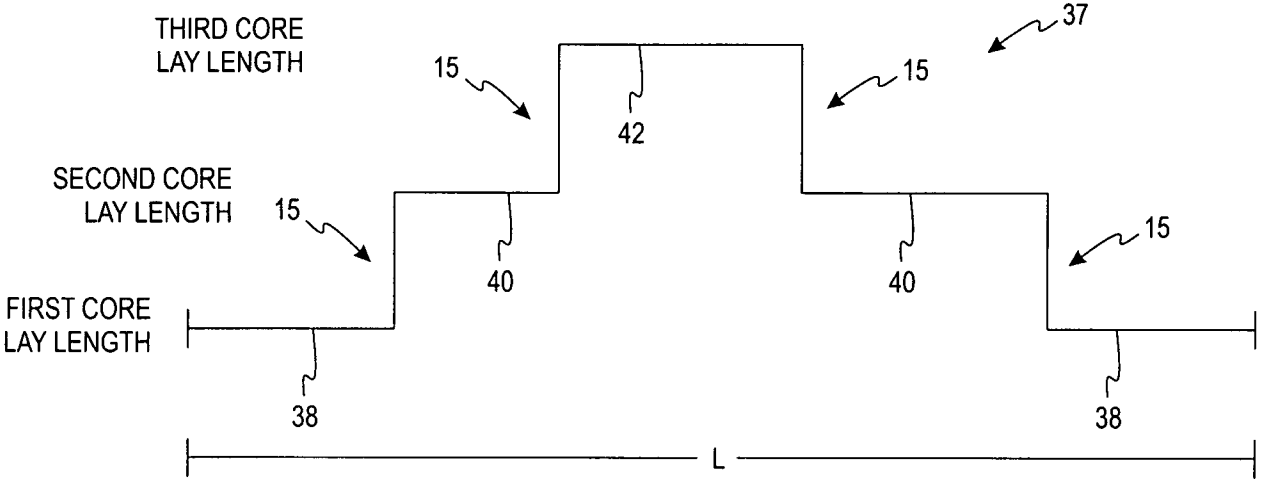
FIG. 8 is a graphical view of a length of cable having three different core lay lengths along the length of cable.

According to some embodiments of the present invention, the ratio of core lay lengths of neighboring segments of a cable is 2:1 or a whole number multiple of 2:1. According to other embodiments of the present invention, multiple core lay lengths are used, with a ratio of 1:2:4 among three contiguous neighboring segments. According to another embodiment of the present invention, a ratio of 1:2:4:8 is preserved among four contiguous neighboring segments. According to another embodiment of the present invention, additional core lay lengths may be used, as long as the relationship between the core lay lengths of neighboring segments of the cable is a factor of 2. FIG. 8 is a state diagram of a length L of a cable 37 having first, second, and third core lay lengths. Two segments 38 of the cable 37 have the first core lay length; two segments 40 of the cable 37 have the second core lay length, which is a factor of two greater than or less than the first core lay length; and one segment 42 of the cable 37 has a third core lay length. If the second core lay length is a factor of two greater than the first core lay length, then the third core lay length is a factor of two greater than the second core lay length. Similarly, if the second core lay length is a factor of two less than the first core lay length, then the third core lay length is a factor of two less than the second core lay length.

Figure 9:
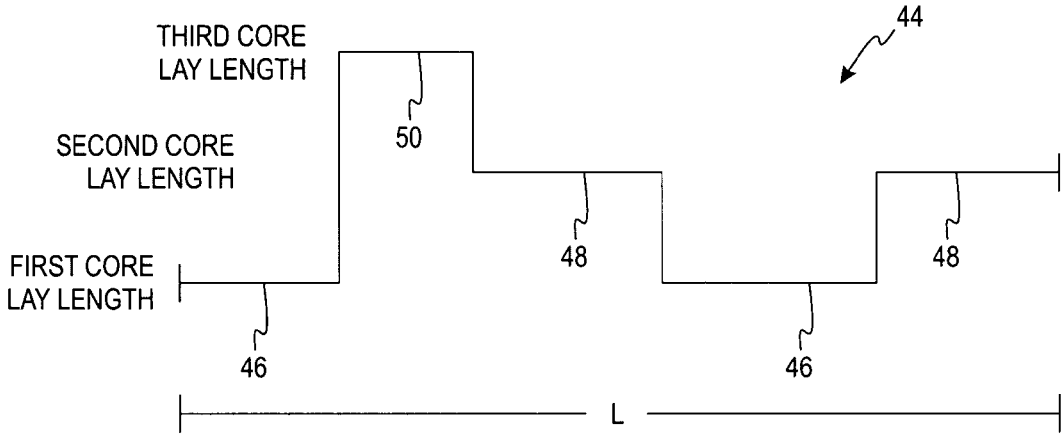
FIG. 9 is a graphical view of a length of another cable having three different core lay lengths along the length of cable.

In an alternative embodiment, neighboring core lay length segments do not necessarily need to have core lay lengths that differ by a factor of two. For example, a cable 44 as illustrated in FIG. 9 may be provided, in which segments 46 have a first core lay length, segments 48 have a second core lay length, and segments 50 have a third core lay length. According to one embodiment, the core lay lengths are related such that if the first core lay length has a value $cl_1$, then the second core lay length has a value of $2cl_1$, and the third core lay length has a value of $4cl_1$. As illustrated in FIG. 9, transitions from the first core lay length to the third core lay length are possible without the need for an intervening segment having the second core lay length. Similarly, transitions may be made from the third core lay length to the first core lay length without the need for an intervening segment having the second core lay length.

In cables according to embodiments of the present invention, the core lay length of the cable in a segment remains fixed throughout that segment before making a transition to the next core lay length. Cables may be provided with a core lay length pattern that repeats itself, and according to one embodiment the core lay length pattern repeats itself approximately every 1000 feet after initial values of the jitter distance z have been selected substantially randomly. According to some embodiments, the core lay length repeats itself from approximately every 500 to approximately every 1500 feet. According to other embodiments, the jitter distance between cable segments is continuously randomly adjusted during cable manufacture, and cables according to such embodiments will have no period over which any alternating cable lay length pattern necessarily repeats itself.

Cables according to the present invention that incorporate jitter distances into the periodicity of the core lay lengths are capable of reducing PSANEXT noise at frequencies greater than 300 MHz by approximately ten decibels.

According to one embodiment of the present invention, a cable is marked on the exterior of the cable jacket to identify the location and ratio of each core lay length to facilitate optimum installation of each cable.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A communications cable comprising a plurality of twisted pairs of conductors, said twisted pairs of conductors being twisted around one another in core lay lengths that vary along a length of the cable, said communications cable further comprising:

a first cable segment having a first segment length and further having a first core lay length that is approximately uniform along said first segment length;

a second cable segment having a second segment length and further having a second core lay length that is approximately uniform along said second segment length, said second core lay length being different from said first core lay length; and a first transition region between said first cable segment and said second cable segment in which the core lay length of the communications cable transitions between said first core lay length and said second core lay length.

2. The communications cable of claim 1 wherein said second core lay length is approximately double said first core lay length.

3. The communications cable of claim 2 wherein said transition region has a transition region length that is shorter than either of said first segment length and said second segment length.

4. The communications cable of claim 2 wherein said first segment length is different from said second segment length.

5. The communications cable of claim 2 further comprising:

a third cable segment having a third segment length and a third core lay length; and a second transition region between said second cable segment and said third cable segment.

6. The communications cable of claim 5 wherein said third core lay length is approximately equal to said first core lay length.

7. The communications cable of claim 5 wherein said third core lay length is approximately double said second core lay length.

8. The communications cable of claim 5 wherein said third segment length is different from at least one of said first segment length and said second segment length.

9. A method of manufacturing a communications cable comprised of a plurality of twisted pairs that are twisted around one another in core lay lengths that vary along the length of the cable, said method comprising:

forming a first cable segment having a first cable segment length and further having a first core lay length that is approximately uniform along said first segment length;

forming a first transition region in which the core lay length of the communications cable transitions between said first core lay length and a second core lay length; and forming a second cable segment having a second segment length and further having said second core lay length, said second core lay length being approximately uniform along said second segment length and further being different from said first core lay length.

10. The method of claim 9 wherein said second core lay length is approximately double said first core lay length.

11. The method of claim 10 wherein forming said transition region comprises forming a transition region length that is shorter than either of said first segment length and said second segment length.

12. The method of claim 10 wherein forming said second segment comprises forming a second segment length that is different from said first segment length.

13. The method of claim 12 wherein said second segment length differs from said first segment length by a jitter distance, said jitter distance being shorter than said first segment length.

14. The method of claim 13 wherein said jitter distance is shorter than one half of said first segment length.

15. The method of claim 14 further comprising randomly determining said jitter distance.

16. The method of claim 15 wherein said second segment length is longer than said first segment length by said jitter distance.

17. The method of claim 10 further comprising:

forming a second transition region in which the core lay length transitions between said second core lay length and a third core lay length; and forming a third cable segment having a third segment length and a third core lay length.

18. The method of claim 17 wherein said third core lay length is approximately equal to said first core lay length.

19. The method of claim 17 wherein said third core lay length is approximately double said second core lay length.

20. The method of claim 17 wherein forming said third cable segment comprises forming a third segment length that is different from at least one of said first segment length and said second segment length.

21. The method of claim 20 wherein said third segment length differs from at least one of said first segment length and said second segment length by a jitter distance that is shorter than said at least one of said first segment length and said second segment length.

22. The method of claim 21 wherein said third segment length is longer than said at least one of said first segment length and said second segment length by said jitter distance.

23. A communications cable comprising four twisted pairs of conductors being twisted around one another in core lay lengths that vary along the length of the cable, said communications cable further comprising:

a first cable segment having a first segment length and further having a first core lay length that is approximately uniform along said first segment length;

a second cable segment having a second segment length and further having a second core lay length that is approximately uniform along said second segment length and is approximately double said first core lay length, said second segment length being different from said first segment length by a jitter distance; and a first transition region between said first cable segment and said second cable segment in which the core lay length of the communications cable transitions between said first core lay length and said second core lay length.

24. The communications cable of claim 23 wherein said jitter distance is randomly determined and is at most half of said first segment length.

25. The communications cable of claim 24 wherein said second segment length is longer than said first segment length by said jitter distance.

26. The communications cable of claim 25 further comprising additional cable segments that alternate between said first core lay length and said second core lay length, segment lengths of said additional segments being different from one another by said randomly determined jitter distance.

27. The communications cable of claim 26 wherein lengths of said first cable segment, said second cable segment, and said additional cable segments comprise a pattern of segment lengths, said pattern of segment lengths being repeated along the length of said cable.

28. The communications cable of claim 27 wherein said pattern of segment lengths has a length between approximately 500 feet and approximately 1500 feet.

* * * * *